US006394832B1

(12) United States Patent
Rantanen

(10) Patent No.: US 6,394,832 B1
(45) Date of Patent: May 28, 2002

(54) EXTENSION PLUG-IN UNIT

(75) Inventor: Kari Rantanen, Itäinen Rantakatu 58 A 6, FIN-20810 Turku (FI)

(73) Assignees: Grand Market Globalizers OY; Kari Rantanen, both of Turku (FI)

( * ) Notice: Subject to any disclaimer, the term of this patent is extended or adjusted under 35 U.S.C. 154(b) by 0 days.

(21) Appl. No.: 09/719,776

(22) PCT Filed: Jun. 17, 1999

(86) PCT No.: PCT/FI99/00532

§ 371 (c)(1),
(2), (4) Date: Dec. 18, 2000

(87) PCT Pub. No.: WO99/66602

PCT Pub. Date: Dec. 23, 1999

(30) Foreign Application Priority Data

Jun. 18, 1998 (FI) ..... 981420

(51) Int. Cl.[7] ..... H01R 4/50
(52) U.S. Cl. ..... 439/341; 439/31
(58) Field of Search ..... 439/341, 376, 439/395, 490, 11, 13, 31

(56) References Cited

U.S. PATENT DOCUMENTS 5,104,331 A 4/1992 Goble
5,639,253 A 6/1997 Rantanen
6,017,214 A * 1/2000 Komai ..... 439/419

* cited by examiner

*Primary Examiner*—Khiem Nguyen
(74) *Attorney, Agent, or Firm*—Oliff & Berridge, PLC

(57) ABSTRACT

An extension plug-in unit comprising a female connector (2) coupled to a first cable (1) and a male connector (4) coupled to a second cable (3), which connectors (2, 4) comprise contacts (7, 8) arranged to establish an electrical connection, the connectors forming a hinge joint when connected together. The extension plug-in unit is characterized in that the hinge joint (11) enables the coupling of the contacts by means of a lateral turning movement that makes the connectors parallel to one another, the connectors comprising stepped inner surfaces (9) whose opposite mating surfaces are provided with the contacts (7, 8), so that during the turning movement the flexibly supported wedge-shaped contact pins (7) of the male connector (4) press into the contact recesses (8) of the female connector (2) to establish an electrical connection.

4 Claims, 2 Drawing Sheets

EXTENSION PLUG-IN UNIT

BACKGROUND OF THE INVENTION

The invention relates to an extension plug-in unit comprising a female connector coupled to a first cable and a male connector coupled to a second cable, which connectors comprise contacts arranged to establish an electrical connection, the connectors forming a hinge joint when connected together.

Extension plug-in units are usually cylindrical in shape, which means that the cables are connected together by inserting the connectors into each other. Thus the size of plug-in units intended for high currents increases to such an extent that it is difficult to handle the connectors and to insert them into each other due to the great frictional forces resisting the insertion.

Further, with cylindrical connectors it is difficult to set up an arrangement where a cable should be branched. The branching requires connections where an additional end with its connectors is branched off from the cable, and it is possible to further couple other units to this end. Such a branching arrangement is rather inflexible in practice and requires a great number of connectors.

In a prior art arrangement, the connectors of the extension plug-in unit are coupled by a hinge-type coupler. The connectors have the shape of a cylinder cut in two where contacts are provided on the cut surface. The hinge is formed at one end of the connectors to be coupled, such that when the connectors are pressed together around an axis of revolution formed by the hinge, the contacts produce an electrical connection. The problem with the extension plug-in units described above is especially how to form the contacts of the female connector in an advantageous and yet reliable manner. According to the prior art, the contacts of the female connector are formed of opposite contact sheets which are spring loaded in order to provide a reliable electrical connection and the compliance required for the coupling. Thus the contacts of the male connector are able to press between the opposite contact sheets of the female connector to form an electrical connection. The female contacts described above have a rather complicated structure and they are thus relatively expensive to manufacture.

BRIEF DESCRIPTION OF THE INVENTION

The purpose of the present invention is to provide an extension plug-in unit which avoids the aforementioned drawbacks and enables the coupling of cables in a reliable manner but with a simpler connector structure than previously. This is achieved with an extension plug-in unit according to the invention, which is characterized in that the hinge joint enables the coupling of the contacts by means of a lateral turning movement that makes the connectors parallel to one another, the connectors comprising stepped inner surfaces whose opposite mating surfaces are provided with the contacts, so that during the turning movement the flexibly supported wedge-shaped contact pins of the male connector press into the contact recesses of the female connector to establish an electrical connection.

The extension plug-in unit according to the invention is based on the male and the female connector being connected by means of a hinge joint. The hinge joint is formed such that the connectors are placed parallel to each other by turning them in the lateral direction. The contacts of the connectors are then able to form an electrical connection together. The contacts are provided on the inner surfaces of the connectors that are pressed together, and the male contacts are wedge-shaped and flexibly supported on the connector. The female connectors, in turn, are v-shaped recesses which are able to receive, during the coupling, the flexibly supported male connectors to form a reliable electrical connection.

The advantage of the connector according to the invention is its reliability which is achieved in the cable coupling by means of a minimal physical force. Further, the structure of both the male and the female connector is simple, wherefore the connectors can be manufactured with simple technology and low costs.

BRIEF DESCRIPTION OF THE FIGURES

In the following, the invention will be described in greater detail in connection with preferred embodiments with reference to the accompanying drawings, in which.

DETAILED DESCRIPTION OF THE INVENTION

Figure 1:
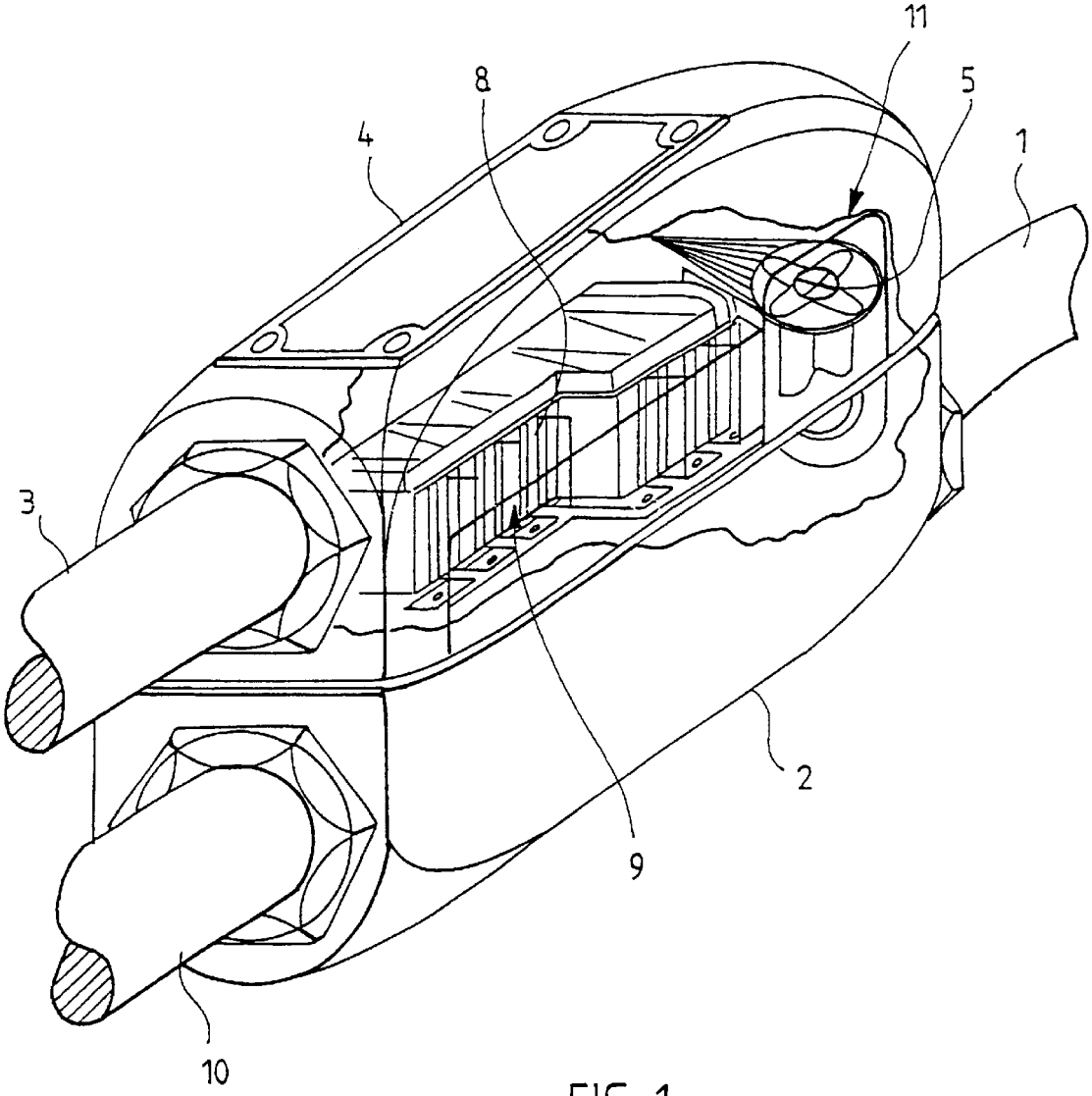
FIG. 1 is a partial cross-sectional view of an extension plug-in unit according to the invention.
Figure 2:
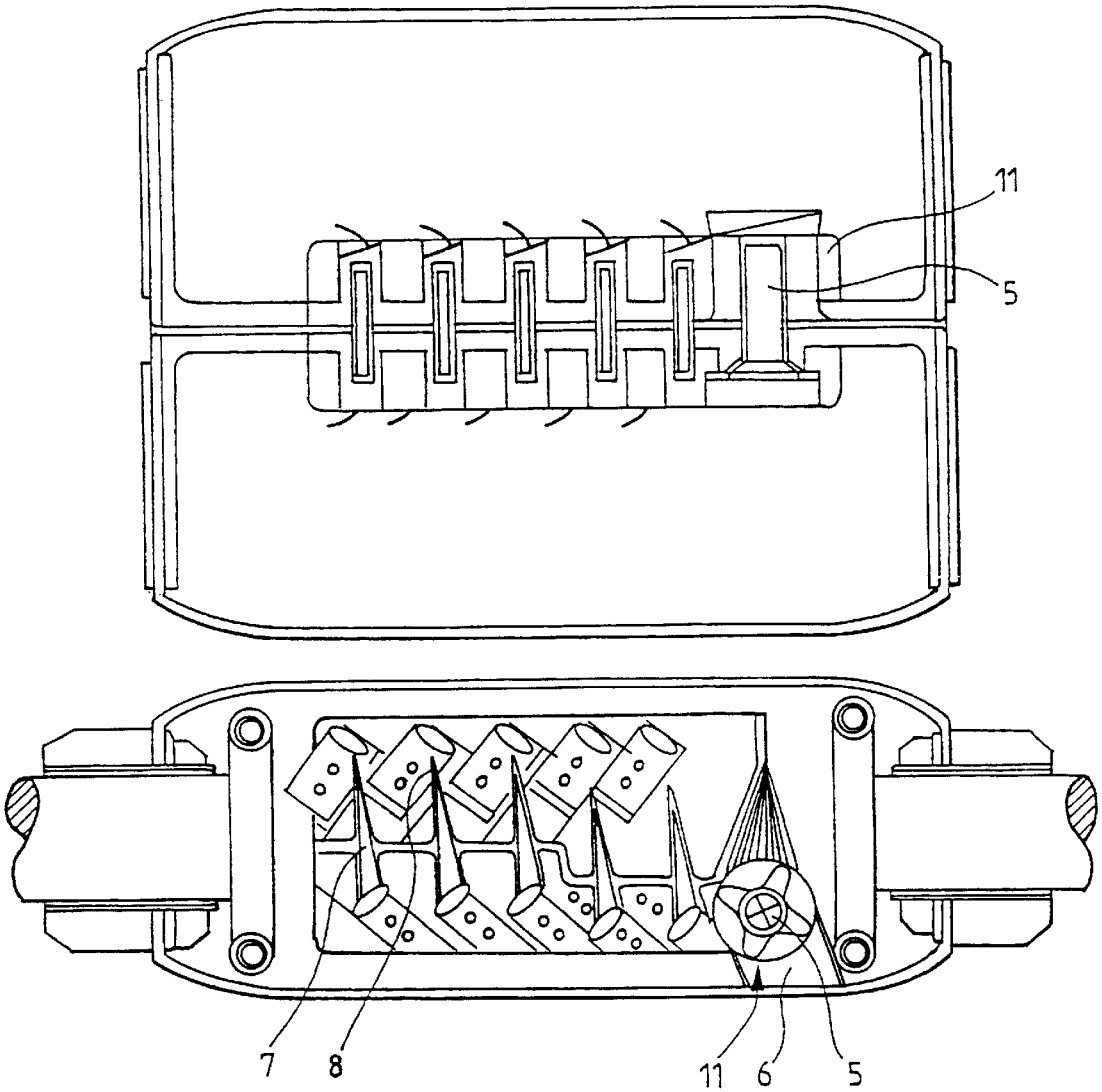
FIG. 2 is a cross-sectional view of the extension plug-in unit according to the invention in a side and top perspective.

The extension plug-in unit according to the invention shown in FIG. 1 comprises a first cable 1 connected to a female connector 2 and a second cable 3 connector to a male connector 4. The cable conductors are coupled to the contacts of the corresponding connectors in order to establish an electrical connection of the cables. FIG. 1 shows the connectors attached together. The connectors are connected by means of a hinge joint, wherein one connector comprises a pivot 5 and the other connector comprises an aperture formed for the pivot. In the embodiments shown in the figures, the pivot 5 is a fixed part of the female connector, whereas the aperture 6 which is a counterpart of the pivot in the joint is a part of the male connector 4.

The male connector and the female connector are coupled by inserting the pivot 5 into the aperture 6 sideways such that the connectors are at a predetermined angle with respect to one another, whereupon the pivot is able to move into the aperture. The connectors are coupled together mechanically by turning the connectors in the lateral direction with respect to one another around an axis of revolution formed by the pivot. The pivot is then positioned substantially perpendicularly to the cables to be coupled. According to an embodiment of the invention, the pivot comprises a self-restrained wedge-shaped piece which locks the connectors together in a mechanically reliable manner as they are being coupled. The locking of the connectors thus requires only that the connectors are coupled in the manner described above by turning them so that they become parallel. There may also be other alternative ways of locking.

According to the invention, the contacts 7 of the male connector 4 are wedge-shaped and they are flexibly supported on the male connector. The contacts 8 of the female connector, in turn, are wedge-shaped recesses which are arranged to receive the male contacts in order to establish an electrical connection. The contacts of the connectors are provided on stepped inner surfaces 9 of both the male connector and the female connector. When the coupling is carried out by screwing the connectors together, each of the flexibly supported contacts of the male connector slides into its own terminal in the female connector as the inner surfaces of the connectors press together. The flexibly supported contacts of the male connector ensure that during the coupling the contacts press tightly against the female contacts. The female contacts are formed such that during the coupling of the connectors the flexibly supported male contacts press against the female contacts and simultaneously yield slightly in the wedge-shaped recess. As a result, the pressure produced by the yielding makes the electrical connection more reliable. The male contacts can be made to yield, for example, by utilizing the flexible properties of the contacts made of metal, or alternatively, by loading the wedge-shaped contacts by springs or other corresponding auxiliary parts.

The extension plug-in unit according to the invention can be provided with a required number of contacts depending on the needs in each situation. In the embodiment shown in the figures, the connectors comprise three phase contacts, a neutral contact and a protective earth contact. There may also be different types of contacts intended for signalling.

According to an embodiment of the invention, the inner surface of the connectors is formed such that when the connectors are coupled, certain contacts form an electrical connection prior to the other contacts. In the embodiment shown in the figures, this arrangement is provided such that the contacts that are to establish a connection first are placed closest to the hinge joint. The female terminals of the contacts to make the first connection are also provided closer to the male contacts in the direction of turning, which means that the female contacts are located in a projection and the male contacts are situated in a recess corresponding to the projection. In the embodiment shown in the figures, two contacts are arranged to be connected before the other three contacts. In the example, the contacts that are to be connected first are shielded and neutral contacts. This provides a safe order of coupling where the phase contacts are only connected after the shielded and neutral contacts.

FIG. 1 shows an extension plug-in unit where a third cable 10 is coupled to the female connector 2. The third cable is coupled directly to the first cable connected to the female connector. It is then possible to couple to the cable by branching it by means of the extension plug-in units according to the invention. This type of cable branching is simple to implement and reliable in use. In this manner, it is possible to implement, for example, cable arrangements at construction sites, wherein female connectors can be positioned in suitable places in the building and, if required, a corresponding male connector can be coupled to the female connectors. The extension plug-in unit according to the invention is especially suitable for currents of 16A to 63A, but other currents are also possible.

It is obvious for those skilled in the art that the basic idea of the invention can be implemented in various ways. The invention and the embodiments thereof are thus not restricted to the examples described above but they may vary within the scope of the claims.

What is claimed is:

1. An extension plug-in unit, comprising:

a female connector coupled to a first cable;

a male connector coupled to a second cable, wherein the male and female connectors include contacts arranged to establish an electrical connection, the male and female connectors having opposing parts of a hinge joint which when connected together places the male and female connectors in a pre-mating position and the hinge joint enables the coupling of the contacts by means of a turning movement that slidingly engages mating surfaces of the male and female connector together while the connectors are substantially parallel to one another, the connectors having stepped inner surfaces where opposite mating surfaces are provided with the contacts, so that during the turning movement flexibly supported wedge-shaped contact pins of the male connector press into contact recesses of the female connector to establish an electrical connection.

2. An extension plug-in unit according to claim 1, wherein a pivot forming the hinge joint comprises a self-restrained wedge-shaped locking means arranged to lock the connectors mechanically together as a result of the turning movement made in order to couple the connectors.

3. An extension plug-in unit according to claim 1, wherein a stepped inner surface of the connector pair comprises in one connector a projection and in the other connector a corresponding recess, the projection and the recess being provided with one or more contracts in order to establish an electrical connection with said contacts prior to the other contacts during the coupling.

4. An extension plug-in unit according to claim 2, wherein a stepped inner surface of the connector pair comprises in one connector projection and in the other connector a corresponding recess, the projection and the recess being provided with one or more contract in order to establish an electrical connection with said contacts prior to the other contacts during the coupling.

* * * * *